US007010260B2

(12) United States Patent
Behnke et al.

(10) Patent No.: US 7,010,260 B2
(45) Date of Patent: Mar. 7, 2006

(54) METHOD AND TRANSPORT APPARATUS FOR PRE-FUSING TONER ON A PRINT MATERIAL

(75) Inventors: Knut Behnke, Kiel (DE); Frank-Michael Morgenweck, Molfsee (DE); Domingo Rohde, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 161 days.

(21) Appl. No.: 10/717,751

(22) Filed: Nov. 20, 2003

(65) Prior Publication Data

US 2004/0218954 A1 Nov. 4, 2004

(30) Foreign Application Priority Data

Jan. 17, 2003 (DE) ..... 103 10 587

(51) Int. Cl.
*G03G 15/00* (2006.01)

(52) U.S. Cl. ..... 399/401; 399/400; 399/320

(58) Field of Classification Search ..... 399/400, 399/401, 311–313, 306, 341, 320, 328–333; 430/124

See application file for complete search history.

(56) References Cited

U.S. PATENT DOCUMENTS

| | | | | |
|---|---|---|---|---|
| 3,757,081 | A | 9/1973 | Smith et al. | |
| 4,639,405 | A * | 1/1987 | Franke | 430/124 |
| 5,157,447 | A * | 10/1992 | Farnand et al. | 399/331 |
| 5,652,949 | A | 7/1997 | Ogawa et al. | |
| 5,978,641 | A * | 11/1999 | Wayman et al. | 399/329 |
| 6,535,711 | B1 * | 3/2003 | Rohde et al. | 399/306 |
| 6,687,483 | B1 * | 2/2004 | Chen et al. | 399/341 |
| 2004/0096249 | A1 * | 5/2004 | Behnke et al. | 399/328 |
| 2004/0218950 | A1 * | 11/2004 | Gogate et al. | 399/329 |

FOREIGN PATENT DOCUMENTS

| | | |
|---|---|---|
| DE | 44 20 196 C | 12/1996 |
| EP | 0 821 291 A1 | 7/1997 |
| JP | 09160311 A | 6/1997 |
| WO | WO 92/0641 | 4/1992 |

* cited by examiner

*Primary Examiner*—Minh Chau
(74) *Attorney, Agent, or Firm*—Lawrence P. Kessler

(57) ABSTRACT

Transporting print material covered on the front side with toner for back side printing in which the toner is prefused on the front side of the print material by heating the toner over its glass transition temperature prior to returning the print material for back side printing.

15 Claims, 3 Drawing Sheets

METHOD AND TRANSPORT APPARATUS FOR PRE-FUSING TONER ON A PRINT MATERIAL

FIELD OF THE INVENTION

The invention concerns a print material transport having a pre-fusing heat source.

BACKGROUND OF THE INVENTION

The field of printing involves diverse printing principles. In this connection, please refer to "Handbuch der Printmedien" (Handbook of Print Media), by author Helmut Kipphan, Springer Verlag, Berlin, Heidelberg, N.Y., ISBN 3-540-66941-8, 2000 edition, particularly pages 41–61, 172–183, and 709–792. In an electrophotographic printing press, toner is transferred to a print material and forms a print image. However, after the transfer of the toner, the print image is not immediately sufficiently securely bonded to the print material; the toner is subsequently interlocked with the print material and fused onto it. For this purpose, the prior art uses fusing rollers, which roll along the print material and securely fuse the toner on the print material with the aid of heat and pressure. This fusing technique necessitates the usage of an offset preventative, e.g., silicone oil. A significant problem in using offset preventing silicone oil is that in two-sided printing, also known as duplex printing, oil on the print material is transferred back into the printing press. The highly isolating effect of the oil can lead to printing imperfections, even if minute quantities of the oil make their way into the printing process so that the image quality of the printed image is impaired, or the printing press may be adversely effected.

SUMMARY OF THE INVENTION

The object of the invention is to securely fuse toner on a print material and to largely avoid the disadvantages described above. According to the invention, transport of a print material, covered on the front side with toner for two-sided printing, is pre-fused on the front side through heating over its glass transition temperature. At least one heat source is used for pre-fusing toner on the front side of the print material before printing the opposite side. With the aid of the invention, no offset preventing silicone oil soils the printing press and adverse effects (printing imperfections) in the printing process is avoided.

In a particularly beneficial manner, the toner is heated by a print material transport. In this manner, additional apparati for heating are saved. In a beneficial manner, the print material transport is heated by a heat source in the transport. The heat source is integrated into the transport, which leads to a space-saving arrangement.

In an embodiment of the invention, the temperature of the heat source is particularly controlled. In this manner, different applications, print materials, or toner types may be taken into account. The temperature is pre-selected according to a given application so that the fusing of the toner on the print material takes place in a suitable manner.

In a beneficial manner, the print material covered on the front side with toner is heated to the fusing temperature prior to the printing on the opposite side, and the print material is heated after opposite side printing only to a lower temperature than the fusing temperature. In this manner, any damage to the previously fused front side print image due to high fusing temperature is avoided. In a further embodiment, the print material transport is heated to different degrees at different locations, and a plurality of different heated regions arises on the transport. On the heated transport, therefore, a plurality of print materials can be heated with different temperatures.

In a beneficial manner, ventilators provide low pressure, which convey the print material on the transport and cool the print material in a controlled manner. Due to the cooling action of the transport, the adaptation of the temperature of the transport to the respective application is improved.

In a particularly beneficial manner, heating of the print material is measured, and heat is fed to the print material in a controlled manner on the basis of the heat measurement, the fusing being enabled in a particularly well-adapted manner. In an embodiment of the invention, resistance wires are provided in the transport. They can be installed in the transport in a simple manner and are individually controllable. In a further embodiment of the invention, an orientation of the resistance wires parallel to the direction of motion of the transport takes place. In a further embodiment of the invention, an orientation of the resistance wires perpendicular to the direction of motion of the transport takes place.

The heat source beneficially includes a screen that contains individually controllable resistance wires, providing for an improvement in the control of the transport temperature. In order to further improve the control of the temperature of the transport, the controllable resistance wires are titanium and/or tungsten.

A simple arrangement for the transport is achieved if the heat source includes perforated plates. For the purpose of obtaining a simple arrangement of the transport, the heat source includes heater bands, which can be bonded on the transport.

To avoid damage to the print material, a shaft encoder is provided on a drive roller for sensing the speed of the transport, and a controller is provided for switching off the heat source in the event of a suspension of the operation of the transport. If the shaft encoder senses that the transport has halted, the heat source is switched off; if the shaft encoder senses that the transport has started up, the heat source is switched on.

BRIEF DESCRIPTION OF THE DRAWINGS

Embodiments of the invention are described hereinafter based on the following figures.

DETAILED DESCRIPTION OF THE INVENTION

Figure 1:
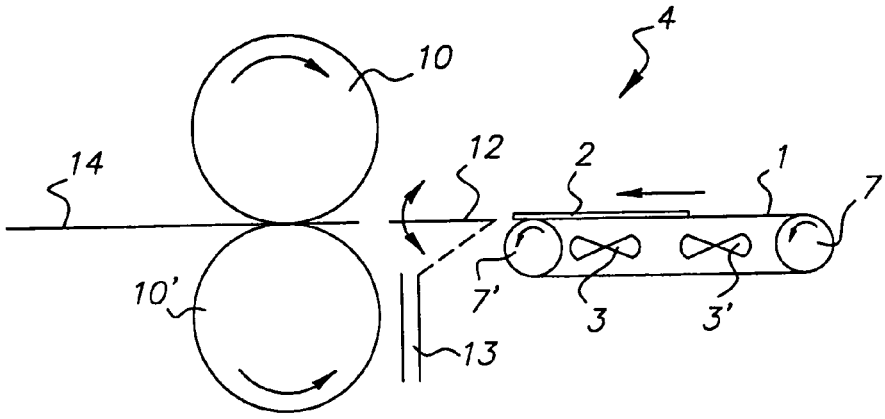
FIG. 1 is a schematic lateral view of a print material transport with ventilators, a switch for the print material and fusing rollers.

FIG. 1 shows a schematic lateral view of a print material transport apparatus 4 of an embodiment of the invention. The transport apparatus 4 includes a transport belt 1, which is tensioned over two rollers 7, 7' which are driven to move in the direction shown in FIG. 1, and drive the upper run of the transport belt 1 in the direction of the straight arrow. Here, the transport belt 1 for conveying the print material 2 is a continuous conveyor belt. The transport belt 1 conveys a print material 2 in case a sheet of paper through a printing press. The transport belt 1 is formed with holes, which extend completely through the transport belt 1 and along it.

In the interior region of the belt arrangement, which is formed from the rollers 7, 7' and the transport belt 1, there are ventilators 3, 3'. The ventilators 3, 3' produce low pressure in the interior region, which causes the print material 2 to be drawn, by pressure differential through the holes in the transport belt 1, to the transport belt 1. A transport belt 1, that is formed as a conveyor belt, which exhibits this principle, is known as a vacuum conveyor belt. Due to the air current, which arises from the low pressure produced by the ventilators 3, 3', the transport belt 1 is quickly cooled.

The space between the rollers 7, 7', and the transport belt 1 is, for the purpose of this invention, essentially closed. In the transport belt 1, a heat source is formed which heats the transport belt 1 in a controlled manner. For example, the heat source is woven into the fabric strip of the transport belt 1 and includes a resistance heater. Here, the temperature to which the transport belt 1, with the print material 2 transported thereby, is heated is variable and can be adapted to different applications. Due the heating of the transport belt 1, the print material 2 with applied toner is heated. The toner is melted on the print material 2 in a manner such that the toner will not loosen from the print material 2 due to subsequent contact with printing press parts during the printing process.

After the transport belt 1, downstream in the direction of motion of the print material 2, there is a switch 12 which can be swiveled in the directions shown by the curved arrow. The switch 12 is controlled by a controller 25, (see FIG. 3) of the printing press such that the print material 2 is fed in a first case to a transport path 14 with fusing rollers 10, 10', the switch 12 being swiveled to its upper position; and in a second case is fed to a path 13, the switch 12 being turned to its lower position. In both cases, the print material 2 is provided on its front side with a print image. In the first case, only a front print is carried out, and in the second case, a front print and, subsequently, a back print are carried out, i.e., the print material 2 is printed on both sides.

If the print material 2 is printed only on one side, the transport belt 1 has, a low temperature and maximally reaches the glass transition temperature of the toner on the print material 2. This temperature below the glass transition temperature of the toner is referred to as the preheating temperature. After the fusing by the fusing rollers 10, 10', the print material 2 is delivered to an extension of the printing press; the print material 2 is not fed back to the printing press. The offset preventing silicone fusing oil on the fusing rollers 10, 10' can thus not make its way back into the printing press. In the case of two-sided printing, the print material 2 which has been printed on the front side and heated by the transport belt 1 is not fed to the fusing rollers 10, 10', but instead is fed to a turning apparatus in the printing press. Through the bonding of the toner with the print material 2 due to the heating on the transport belt 1, turning of the print material 2 is possible without damaging the print. There is no risk of fusing oil being deposited on parts of the printing press in an undesired manner.

In the case of two-sided printing, the toner is already heated to temperatures above the glass transition temperature of the toner when the print material 2 is printed on the front side. The print material 2 is printed on its back printing side and conveyed anew on the transport belt 1, heated to the preheating temperature, and, then fed to the fusing rollers 10, 10', with the toner bonded to the print material 2 in a definitive manner. It should be noted that the toner is only heated below its glass transition temperature when both sides of the print material 2 are printed. In this subsequent fusing step, the desired image quality is obtained with regard to the fusing on both sides of the print material 2. Subsequently, the print material 2 is delivered to the extension of the printing press.

If the print material 2 leaves the transport belt 1, and reaches the fusing rollers 10, 10', the print material 2 is heated by the heated transport belt 1. The fusing rollers 10, 10' can be heated to a lesser degree than previously known; the amount of energy required by the fusing rollers 10, 10' is reduced by the amount of energy provided by the transport belt 1. In the case of two-sided printing, also known as duplex printing, the heated transport belt 1 is used accordingly for pre-fusing for the first printed side of the print material 2 (the front side), whereas it is used for the second printed side of the print material 2 (the back printing side), for the purpose of heating the print material 2.

Another essential difference compared to the prior art printing process is that no offset preventing silicone fusing oil from the fusing rollers 10, 10' gets into the printing press since during duplex printing the print material 2 is not taken by the fusing rollers 10, 10' (with the offset preventing oil) until the print material 2 has been printed on both sides and is delivered after the fusing by the fusing rollers 10, 10' to the extension. When using offset preventing oil in the prior process, such oil is transferred back during back printing or duplex printing into the printing press. Due to the highly isolating effect of the offset preventing oil, the entry of oil into the printing process, particularly in the case of an electrophotographic process, can lead to imperfections in the printing process, even for minute quantities, so that the print quality of the printed image suffers. This problem is avoided as described above.

Figure 2:
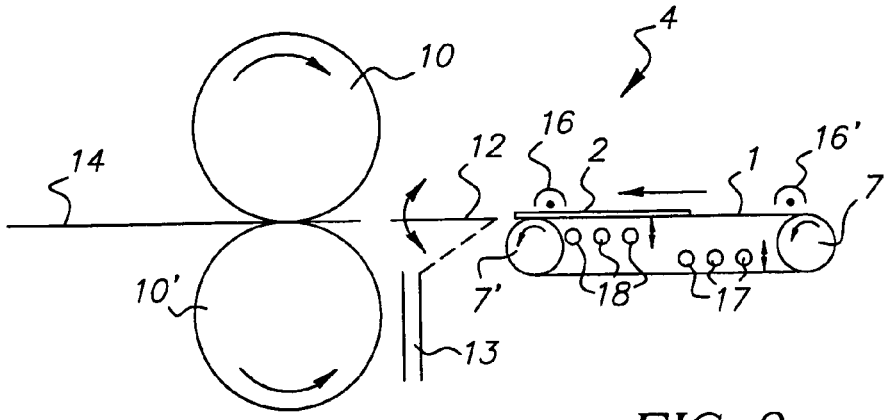
FIG. 2 is a schematic lateral view of a print material transport with heating rollers and cooling rollers that can be swiveled.

FIG. 2 shows a schematic lateral view of a transport apparatus 4 as a further embodiment of the invention. Two rollers 7, 7' are provided which rotate in the direction shown by the arrows and drive the transport belt 1. On the transport belt 1, a print material 2 is transported in the direction shown by the arrow. Above the transport belt 1, two corona chargers 16, 16' are arranged which provide an electrical alternating field, by which an electrostatic force is produced on the transport belt 1. The electrostatic force of the corona charger 16 attracts the print material 2, at the entrance to the transport belt 1, to the transport belt 1, and the attraction force at the exit from the transport belt 1 is neutralized by the corona charger 16'.

Within the runs of the transport belt 1, rollers 17, 18 that can be swiveled are arranged. Rollers 18 are provided for heating the transport belt 1, and rollers 17 are provided for cooling the transport belt 1. If the transport belt 1 is, for example, an electrostatic belt made of non-conductive plastic, for a sufficient mechanical stability, it has a minimum thickness, which in turn prevents fast temperature changes. Accordingly, a fast change of the temperature of the transport belt 1 can be guaranteed only if cooling elements are also used additionally.

Instead of cooling rollers 17, ventilators or cooling surfaces can be used on which the transport belt 1 is guided. The number of necessary heating sources and cooling sources is determined by the required switching speed between heating and cooling. Here, the term "switching speed" designates the time, which is needed for changing heating or cooling of the transport belt 1. The heating rollers 18 and the cooling rollers 17 can be swiveled to a first position in contact with the transport belt 1, and can be swiveled to a second position remote from the transport belt 1. Preferably, the heating rollers 18 lie in contact with the transport belt 1, when the cooling rollers 17 are swiveled to the remote position from the transport belt 1, and do not make contact with it in order to increase the temperature of the transport belt 1. Or the heating rollers 18 are swiveled to the remote position from the transport belt 1, and the cooling rollers 17 contact the transport belt 1 in order to decrease the temperature of the transport belt 1.

Behind the transport belt 1, downstream in the direction of motion of the print material 2, there is a switch 12 which can be swiveled in the directions shown by the curved arrow. The switch 12 is controlled by a controller 25 of the printing press, such that the print material 2 is fed in a first case to the transport path 14 having fusing rollers 10, 10', the switch 12 being swiveled to its upper position; and, in a second case, is fed to a path 13, the switch 12 being swiveled to its lower position. The swiveling motion of the heating rollers 18 and the cooling rollers 17 is shown schematically in FIG. 2 with double-sided arrows. The fast change of the temperature of the transport belt 1, for example, by the heating rollers 18 and the cooling rollers 17, is an important property in the fusing procedure in all of the described embodiments.

Figure 3:
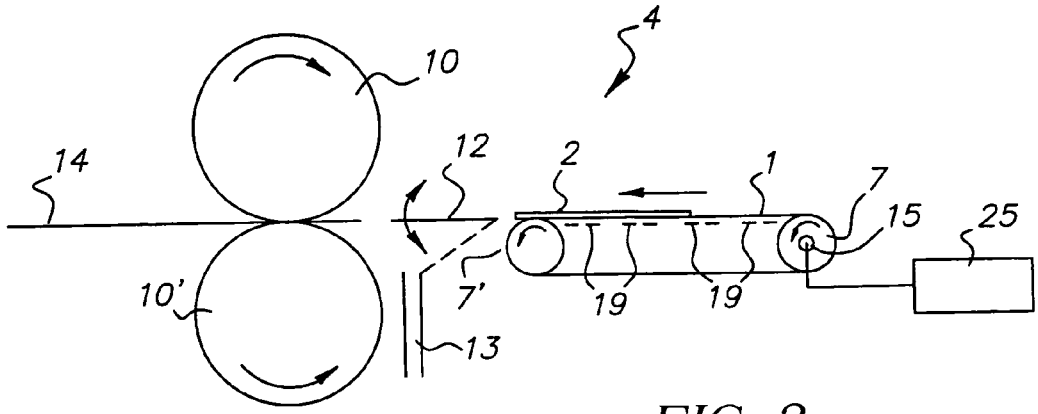
FIG. 3 is a schematic lateral view of a print material transport with a screen for heating the transport, a shaft encoder for determining the speed of the transport, and a controller for controlling the speed of the transport and the temperature of the transport.

FIG. 3 shows another embodiment of the invention with rollers 7, 7' around which a continuous transport belt 1 runs, similar to FIGS. 1 and 2. Unlike the previous embodiments, in this embodiment perforated plates 19 are arranged in association with the transport belt 1 on the opposite side from the side carrying the print material 2. The individual perforated plates 19 are arranged in the transport direction of the transport belt 1 one after another. The perforated plates 19 are controlled individually and/or in groups using electrical power to generate heat for the transport belt 1. In this manner, the transport belt 1, and the print material 2 conveyed by it, are heated in a controlled manner.

Different locations on the transport belt 1 may be heated differently, and/or successive print materials 2 on the transport belt 1 can be heated differently. On a roller 7, a shaft encoder 23 is arranged which monitors the rotational motion of roller 7 and senses if roller 7 is still. If roller 7 is still, the transport belt 1 is still. This is determined by the controller 25, which is connected to the shaft encoder 23. The case of the transport belt 1 standing still can lead to the print material 2 being heated to an excessive degree; accordingly, the perforated plates are then controlled such that they are not heated further, and an undesirably high heating of the print material 2 is thereby avoided.

Another embodiment discloses, instead of the perforated plates 19, resistance wires 20 which can be controlled individually and/or in groups, by which a higher heating speed and cooling speed is attained. Moreover, smaller regions of the transport belt 1 can be heated. A further embodiment of the transport apparatus 4 discloses applying heater bands on the underside of the transport belt 1, the underside being the side turned away from the print material 2. Preferably, the heater bands are bonded to the transport belt 1.

The control of the temperature of the respective heat sources by the controller 25 can be implemented differently. For example, simple two-point control can be provided in which a distinction is made between two temperatures. The first temperature in the two-point control is adjusted if during two-sided printing on the front side the print material 2 is heated to a large degree so that the temperature on the print material 2 lies above the glass transition temperature of the toner. The toner is then melted on to the print material 2. Subsequently, the print material 2 is fed for printing of the second side, the back printing side. The second temperature is adjusted if during two-sided printing on the back printing side, or during single-sided printing, the print material 2 is heated to a lesser degree so that the temperature on the print material 2 lies below the glass transition temperature of the toner. The front printing side which was already fused during two-sided printing is not damaged in this manner during the fusing of the back printing side; the toner on the print material 2 essentially retains its state during heating on both sides and does not melt.

Another possibility for adjusting the temperature involves the use of a control circuit, the temperature of the heat source being controlled as a function of the temperature of the print material 2. For example, an infrared sensor can be provided as a transducer, the infrared sensor determining the temperature on the surface of the print material 2 in a contactless manner. Based on the measurement of the temperature of the print material surface, the controller 25 controls the heating of the heat source. The temperature during pre-fusing is adjusted such that during simple printing it remains below or equal to the glass transition temperature, whereas in two-sided printing during pre-fusing of the first side it is heated above the glass transition temperature, and after turning during the subsequent pass of the second side of the print material 2, it is heated to below or equal to the glass transition temperature. Here, the temperature below the glass transition temperature is designated as the preheating temperature.

Figure 4:
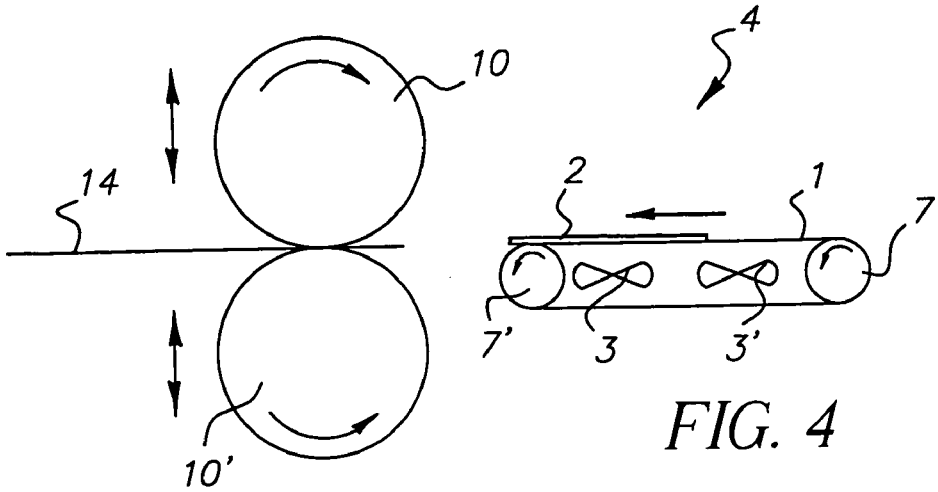
FIG. 4 is a schematic lateral view similar to FIG. 1, with fusing rollers arranged behind the transport, and in which fusing rollers have been moved to a position in juxtaposition with the print material transport path.
Figure 5:
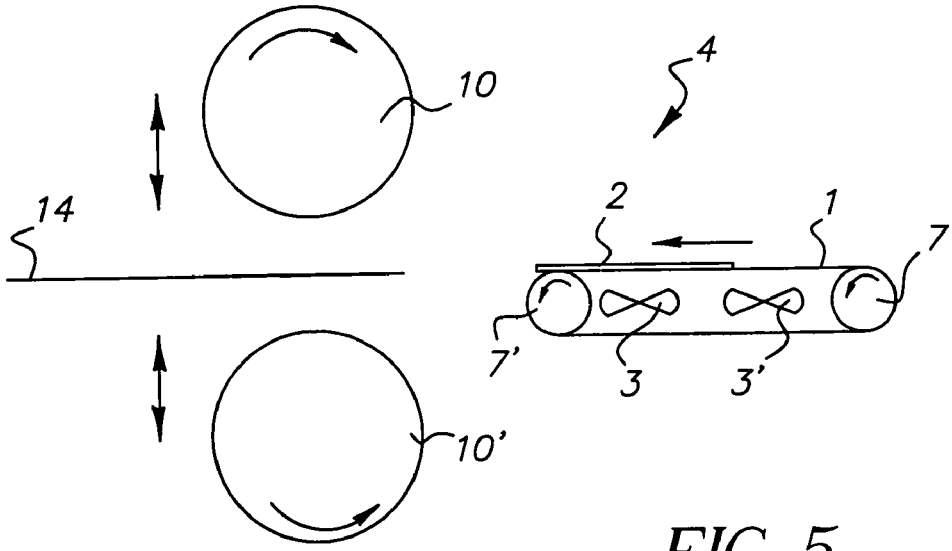
FIG. 5 is a schematic lateral view similar to FIG. 4, with the fusing rollers being moved to a position remote from the transport path.

FIG. 4 shows a similar arrangement to FIG. 1 but in which no switch 12 is provided. The fusing rollers 10, 10' are formed in this embodiment such that the fusing rollers 10, 10' downstream from the transport belt 1 can be swiveled relative to the transport path 14 on which the print material 2 is conveyed. As such, the fusing rollers 10, 10' form a nip at the transport path 14 and contact the print material 2 with the toner to transport the print material. This is the case during single-sided printing and during two-sided printing if the print material 3 is turned and the printed back-side is directed upwards. In the other case (as shown in FIG. 5), the fusing rollers 10, 10' can be swiveled to a position remote from the transport path 14 so that the fusing rollers 10, 10' do not contact the print material 2 with toner. The fusing rollers 10, 10' are swiveled to the remote position when two-sided printing is carried out prior to turning the print material 2 from the front side to the back side for printing, (i.e., and the front side being directed upwards).

Figure 6:
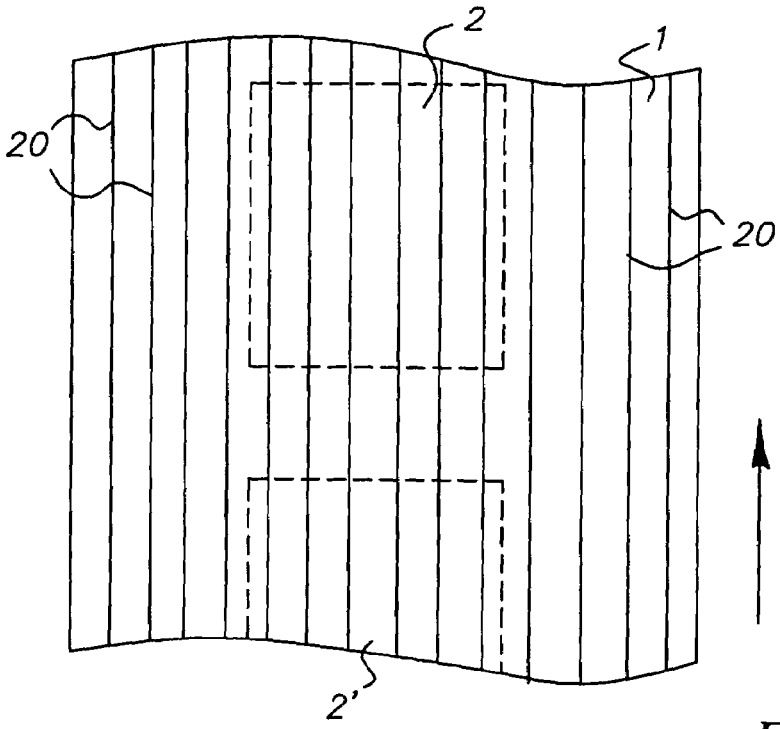
FIG. 6 is a top view of a section of a segment of the print material transport with resistance wires oriented vertically to the transport direction and contact bands for local heating of the transport.

FIG. 6 shows a top view of a section of a segment of the transport belt 1. Here, the transport belt 1 for conveying the print material 2 is a continuous conveyor belt. The transport direction of the transport belt 1 is shown with a straight arrow. The resistance wires 20 are arranged as heat sources, substantially parallel to the transport direction of the transport belt 1 and the print material 2 on the transport belt 1. The resistance wires 20 run along the entire width of the transport belt 1. The deflection pulleys or rollers 7, 7' act on the ends of the transport belt 1 as an electrical contact with the resistance wires 20 via which the electrical power is fed to the resistance wires 20. The print material 2 is shown in FIG. 6 with a dotted line in a phantom representation.

Figure 7:
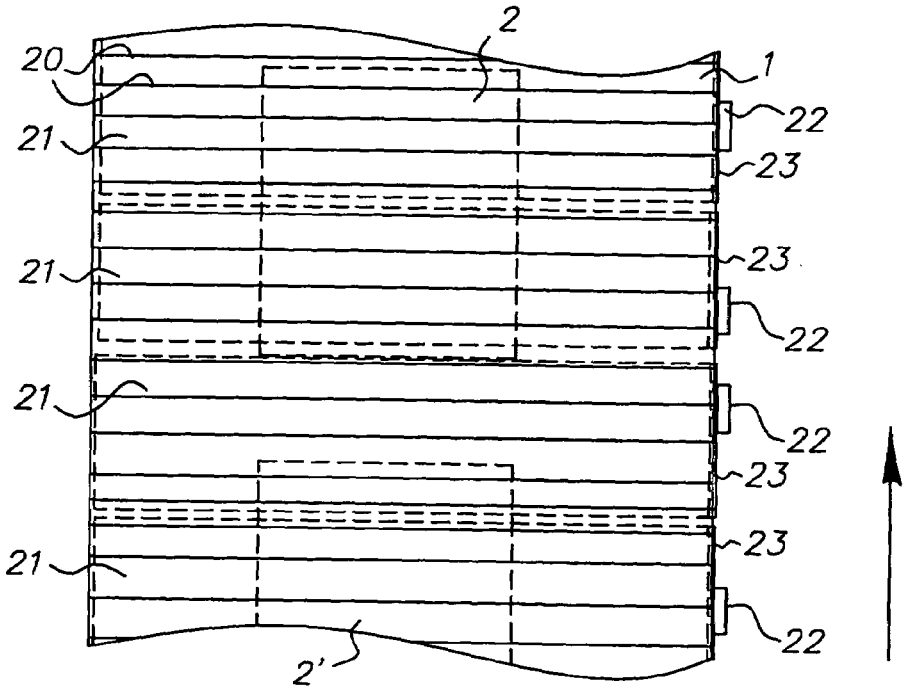
FIG. 7 is a top view of a section of a segment of the transport print material with resistance wires oriented horizontally to the transport direction.

FIG. 7 shows a top view of a section of a segment of the transport belt 1 similar to FIG. 6. The transport direction of the transport belt 1 is shown with the straight arrow. Within the transport belt 1, resistance wires 20 are arranged substantially perpendicular to the transport direction of the transport belt 1 and the print material 2. The resistance wires 20 are supplied with electrical power by contact strips 23 with sliding contacts 22 on a side of the transport belt 1. The contact strips 23 are shown in FIG. 7 using thick lines at the edge of the transport belt 1.

The resistance wires 20 are divided into sections 21 perpendicularly to the longitudinal direction or transport direction of the transport belt 1, a section 21 including a number of resistance wires 20, the individual sections 21 being separated from one another. The individual sections 21 are enclosed by the dashed lines. In FIG. 7, four sections 21 as well as four contact strips 23 are shown, each contact strip 23 having a section 21 associated with it. The sliding contacts 22 are shifted along the individual sections 21, the electrical power released on the resistance wires 20 being changed, and accordingly the heating of the resistance wires 20 being controlled with the individual sections 21. If another heating of the sections 21 with the resistance wires 20 is desired, the positions of the sliding contacts 22 on the contact strips 23 are changed, as controlled by the controller 25.

Each of the four sections 21 into which the segment of the transport belt 1 in FIG. 7 is divided is individually controllable; in each of the sections 21, a different temperature can be set. A print material 2, shown in FIG. 7 with a dotted line in a phantom representation, can be heated, with a different temperature than a following print material 2' on the same transport belt 1 by controlling the upper sections 21 with a different temperature than the lower sections 21.

A benefit of the arrangement of the heat sources as resistance wires 20 in a direction perpendicular to the transport direction of the transport belt 1 with sections 21 is that shorter switching times for heating the transport belt 1 are attainable. The time for changing the temperature of the transport belt 1, from a first low temperature for heating a print material 2 printed on a single side to a second high temperature for heating the front side of a print material 1 to be printed on both sides prior to turning the print material 3, is reduced in this manner. The fast change of temperature of the transport belt 1 is an essential feature in the fusing procedure in the described embodiments.

The invention has been described in detail with particular reference to certain preferred embodiment thereof, but it will be understood that variations and modifications can be effected within the spirit and scope of the invention.

What is claimed is:

1. A method for transporting a print material (2) covered on the front side with toner for printing on the back side, comprising the step of: transporting print material (2) through a heater for pre-fusing toner on the front side of the print material (2), and thereafter transporting the print material (2) for printing on the back side thereof wherein said print material (2) covered on the front side with toner is heated to fusing temperature over the toner glass transition temperature, prior to the back printing and the print material (2) is heated after the back side printing only to a lower temperature than the fusing temperature.

2. A method for transporting a print material (2) covered on the front side with toner for printing on the back side, comprising the step of: transporting print material (2) through a heater for pre-fusing toner on the front side of the print material (2) by heating over the toner glass transition temperature, and thereafter transporting the print material (2) for printing on the back side thereof, wherein said toner is heated by a transport belt (1) for the print material (2), said transport belt (1) being heated to different degrees at different locations.

3. The method according to claim 2, wherein said transport of said print material (2) is by a transport belt (1) which is a conveyor belt.

4. The method according to claim 2, wherein said transport belt (1) is heated by a heat source associated with the transport belt (1).

5. A method for transporting a print material (2) covered on the front side with toner for printing on the back side, comprising the step of: transporting print material (2) through a heater for pre-fusing toner on the front side of the print material (2) by heating over the toner glass transition temperature, and thereafter transporting the print material (2) for Printing on the back side thereof, said heating temperature being selectively controlled by measuring said heating of the print material (2), and heat is fed to the print material (2) in a controlled manner on the basis of the heat measurement.

6. A transport apparatus (4) for transporting print material (2), comprising: a transport belt (1), at least one heat source, associated with said transport belt (1), for pre-fusing toner on the front side of print material (2), transported by said transport belt (1) by heating the toner over the toner glass transition temperature before back side printing, and a switch for returning transported print material for back side printing, wherein said at least one heat source includes resistance wires (20) in said transport belt (1).

7. The transport apparatus (4) according to claim 6, wherein said resistance wires (20) are parallel to the direction of motion of the transport belt (1).

8. The transport apparatus (4) according to claim 6, wherein said resistance wires (20) are perpendicular to the direction of motion of the transport belt (1).

9. The transport apparatus (4) according to claim 6, wherein said at least one heat source includes a screen.

10. The transport apparatus (4) according to claim 9, wherein said screen includes individually controllable resistance wires (20).

11. The transport apparatus (4) according to claim 10, wherein said controllable resistance wires (20) include titanium and/or tungsten.

12. The transport apparatus (4) according to claim 6, wherein said at least one heat source includes perforated plates.

13. The transport apparatus (4) according to claim 6, wherein said at least one heat source includes heater bands which can be bonded onto said transport belt (1).

14. The transport apparatus (4) according to claim 6, further including a shaft encoder (15) on a drive roller (7, 7') for said transport belt (1) for sensing transport belt speed, and a controller (25) for switching off said at least one heat source when said transport belt (1) stops.

15. The transport apparatus (4) according to claim 6, further including fusing rollers (10, 10'), downstream of said transport belt (1), which can be swiveled into operative relation with a transport path (14) for the print material (2) and swiveled to a position remote from the transport path (14).

* * * * *